United States Patent [19]

Stallings, Jr.

[11] 4,057,689

[45] Nov. 8, 1977

[54] HIGH FIDELITY SOUND REPRODUCTION SYSTEM AND MODULES THEREOF

[75] Inventor: Robert J. Stallings, Jr., Sugar Land, Tex.

[73] Assignee: Roy H. Smith, Jr., Houston, Tex.

[21] Appl. No.: 715,694

[22] Filed: Aug. 19, 1976

Related U.S. Application Data

[63] Continuation-in-part of Ser. No. 377,762, July 9, 1973, Pat. No. 3,976,838.

[51] Int. Cl.[2] ..... H04R 1/02

[52] U.S. Cl. ..... 179/1 E; 181/145; 181/150; 181/153

[58] Field of Search ..... 179/1 AT, 1 E; 181/144, 181/145, 146, 147, 148, 149, 150, 151, 152, 153, 154, 155, 156

[56] References Cited

U.S. PATENT DOCUMENTS

| | | | |
|---|---|---|---|
| 1,741,274 | 12/1929 | Baumann | 181/156 |
| 2,881,850 | 4/1959 | Bonn | 181/153 |
| 2,982,372 | 5/1961 | Lowell | 181/155 |
| 3,275,100 | 9/1966 | Dunning | 181/146 |
| 3,473,625 | 10/1969 | Heisrath | 181/146 |
| 3,719,250 | 3/1973 | Maekawa | 181/153 |
| 3,720,285 | 3/1973 | Russell et al. | 181/151 |
| 3,754,618 | 8/1973 | Sasaki | 181/145 |
| 3,912,865 | 10/1975 | Seebinger | 179/1 E |

FOREIGN PATENT DOCUMENTS

| | | | |
|---|---|---|---|
| 1,330,932 | 5/1963 | France | 179/1 E |
| 900,227 | 11/1953 | Germany | 179/115.5 ME |

*Primary Examiner*—George G. Stellar
*Attorney, Agent, or Firm*—Roy H. Smith, Jr.

[57] ABSTRACT

A multiplicity of sound modules are mounted on a number of baffle plates which define an essentially continuous surface, e.g., a ceiling. Each sound module consists of a loudspeaker and a cavity-defining member which may be a thin-walled shell or a rectangular block of lightweight material, e.g., foamed polystyrene. The cavities are preferably spherical and of equal size, and the loudspeakers are preferably identical and electrically interconnected for simultaneous reproduction of a common input signal.

The baffle plates are chosen to correlate with existing interior designs, and thus may be flat or curved, and may cooperatively or individually support one, two or several sound modules. When 2 by 2-foot acoustic tiles are employed, the invention may be thought of as embodied in like units each consisting of a factory assembly of at least one loudspeaker, the same number of cavity-defining members, and a baffle plate in the form of an acoustic tile, the latter not necessarily being of sound absorbent material. The baffle plates collectively cooperate with other interior walls to define a secondary enclosure.

13 Claims, 10 Drawing Figures

HIGH FIDELITY SOUND REPRODUCTION SYSTEM AND MODULES THEREOF

RELATIONSHIP TO OTHER PATENT APPLICATIONS

The present application is a diminished continuation-in-part of the present inventor's copending U.S. patent application Ser. No. 377,762, filed July 9, 1973, now U.S. Pat. No. 3,976,838, the disclosure of which is hereby incorporated herein by reference, and contains additional disclosure.

FIELD OF INVENTION

The present invention deals with high fidelity sound reproduction systems. More particularly, it provides sound modules consisting of loudspeakers and enclosures, and mounting means for such loudspeakers and enclosures, mounting means which also serve as baffle plates or secondary enclosures.

PRIOR ART

The nearest prior art known to the present inventor is his own copending application aforesaid, now U.S. Pat. No. 3,976,838, of which the present application is a continuation-in-part. Therein applicant discloses and claims assemblies of two or more loudspeakers, preferably of the same size and electrically interconnected for reproduction of a common input signal. Each such loudspeaker is disposed in a cavity, which is preferably spherical, so that the outer end of the diaphragm of the loudspeaker is approximately flush with an equal size opening in the cavity-defining member, thereby truncating the cavity and sealing it so that none of the sound emanating from the back face of the diaphragm, facing and operating into the cavity, can escape to the outside.

Also somewhat pertinent is the U.S. patent issued to Maekawa, U.S. Pat. No. 3,719,250, on Mar. 6, 1973. Maekawa discloses a middle and high frequency loudspeaker ("tweeter") mounted in a globe which is pivotally fastened to a flat baffle board, the bulk of the speaker-globe being disposed behind the baffle but a portion protruding from the other side as well. Maekawa was concerned because his loudspeakers were highly directional, suffering severe attenuation in a direction offset from his speaker axis at an angle greater than 30° to 60°. With such a speaker, the disclosed means to avoid directional attenuation is to point the speaker axis directly at the listener, and Maekawa teaches doing this by swinging his loudspeaker on his pivoted mount to aim it directly at the listener.

Maekawa is deficient, however, when one considers an arrangement of a number of loudspeakers. The only system he teaches is disclosed in a drawing figure which shows two of his globe-and-loudspeaker subcombinations disposed in a room with each subcombination mounted in a separate cabinet. He fails to describe the drawing figure showing such arrangement, and only by inference can it be determined that he teaches the apparatus of the figure for the stereophonic sound system mentioned in his introduction. In a stereophonic sound system two or more microphones are employed to pick up separate original sounds, as for instance separate instruments in an orchestral performance, and make separate recordings thereof. Although these are time-correlated in pressing a disc, they are independent signals and are separately amplified in a stereophonic phonograph and amplifying system. Each signal is finally fed from a separate audio transformer into a separate loudspeaker. The two loudspeakers do not produce a cumulative effect by reproducing a common input signal, as in the present inventor's system, but complement each other in that each loudspeaker reproduces sounds which are totally absent from the other.

SHORT STATEMENT OF THE INVENTION

In a preferred embodiment of the present invention a primary enclosure is formed to define a curvilinear cavity, preferably spherical, by any of several structures. Such structure is truncated to form a mounting opening into the concavity, and a loudspeaker is mounted in such opening so that the bulk of the loudspeaker is disposed cantilever fashion within the cavity and the speaker diaphragm, with its attendant structure support, just fills the opening. The loudspeaker and cavity-defining member, whether a shell, a block in which a cavity is formed, or whatever, may together be called a "module."

Each module is then mounted on or in a secondary enclosure or baffle plate, also having a sound opening therethrough, in such manner that the sound opening in the primary enclosure just fills the corresponding opening in the secondary enclosure. In a complete sound reproduction system, there are a multiplicity of modules thus disposed in a like multiplicity of openings in one or more baffle plates, with such openings lieing in an essentially continuous, essentially common surface. The common surface may be plane or curved, and when curved the surface as viewed by listeners may be either convex or concave.

The major utilization of the present invention is in buildings where large number of people congregate and are addressed through a sound reproduction system, e.g., auditoria, concert halls, discotheques, skating rinks and the like. In such a system it would be ideal to design the room to enhance the reproduced signal considered as a point source, for instance by making the ceiling a convex spherical surface. In reality one seldom sees a convex ceiling, and the sound system designer must usually work with a flat ceiling or one that is arched or domed so that the listener looks up into a concavity. Occasionally such a ceiling will be stepped, but the nethermost or inside ceiling surface is usually sufficiently unbroken to fall within the description "an essentially continuous common surface." The present invention may be incorporated in such ceiling surfaces to produce its superior auditory effects, even though they are not considered to be ideal baffle surfaces, and may also be incorporated into similar surfaces of other walls, whether these be room-defining walls (including swimming pools) or walls created especially for the sound system, as in special sound cabinets or speaker boxes.

In the special situation of the "acoustic tiles" now frequently seen in many ceilings, the present invention embraces the concept of a manufactured product consisting of one of these tiles and one or more of the modules of the invention, i.e., a cavity-defining member and a loudspeaker. When the ceiling tiles are of the common 2 by 2-foot size, only one such module will generally be secured to a single tile, but more may be used with larger tiles. Standard tiles and the standard suspended sheet metal edge support systems may be used, even though the standard sound-absorbing tiles are relatively weak and are inclined to sag somewhat when called upon to support additional weight; in such event the modules may be supported by bracing wires secured to the solid ceiling from which the acoustic ceiling is suspended. Preferable, however, is the use of a stronger acoustic tile or baffle plate, one which will not sag under the weight of one or more loudspeaker modules.

Such baffle plates need not be made of sound-absorbing material; indeed, it is preferable that they be of a hard material which will dissipate or radiate sound. The existence of a good baffle surface, i.e., a continuous, smooth, sound reflective surface surrounding each loudspeaker diaphragm and extending from it for several wavelengths in all directions, is an important part of the system. In the presence of such a surface the sound wave fronts emenating from each speaker diaphragm join each other to form a common wave front which avoids the auditory distortions inherent in structures with sharp corners and other irregularities in the area around a speaker. For the same reasons, it is preferable that each loudspeaker be assembled to its primary enclosure, and to its secondary enclosure or baffle plate, so that the speaker diaphragm, or more specifically the supported edge portion at the outer periphery of the diaphragm, neither extends from nor is recessed within such enclosures. Since in either instance the speaker disposition tends to increase sound distortion, the preferred disposition is that in which the outer periphery of the diaphragm is approximately flush with the nether or inside baffle surface of the secondary enclosure, and the openings in the two enclosures are essentially congruent with each other and with the cross section of the diaphragm at its outer, supported periphery.

From the above description the reader might conclude that three separate units are involved — a loudspeaker, a primary enclosure and a secondary enclosure or baffle plate. This is not necessarily the case, however, as the present invention also embraces structures in which the primary enclosure and baffle plate are combined in various ways. The important part of the primary enclosures is that they furnish concavities, preferably spherical, to surround all of the loudspeakers except the front face of the diaphragms, each cavity receiving a separate loudspeaker. The important part of the secondary enclosure, on the other hand, is a large radius baffle surface surrounding a multiplicity of these front faces of the diaphragms. It is immaterial that such baffle surface be furnished by the same structure as that containing the loudspeaker cavities, in whole or in part. The cavities might be defined, for instance, by blocks of hollow material having the diaphragm openings in their lower surfaces, and such surfaces may furnish all or part of the baffle surface.

Also within the purview of the present invention is the combination of a single loudspeaker with a single primary enclosure and a single convex secondary enclosure. In such combination, as an example, the diameter of the primary enclosure, preferably having a spherical or other continuous convex cavity, could be 2 to 10 times the diameter of the loudspeaker diaphragm, and the diameter of the convex secondary enclosure could be 2 to 10 times that of the primary enclosure. Even when such a combination is used as the only sound reproduction means, it produces an effect superior to that obtained with any structure known to the prior art, and superior to that obtained with only a module, i.e., loudspeaker and primary enclosure — especially so when the loudspeaker uses the common cone diaphragm. With such a loudspeaker the smaller primary enclosure effectively squelches and nullifies the effects of the back face of the diaphragm as it pulsates in and out to compress and rarefy the air inside such enclosure, but something more is needed on the outside of such a module. There is some directionality at higher frequencies in the assembly, and for this reason a convex secondary enclosure or baffle surface is needed. With the complete assembly a high degree of omnidirectionality is achieved, and it is unnecessary to pivot the module on the baffle plate.

SHORT DESCRIPTION OF THE DRAWING FIGURES

The present invention may perhaps be better understood by reference to the accompanying drawing in which.

DETAILED DESCRIPTION OF THE DRAWING FIGURES

Figure 1:
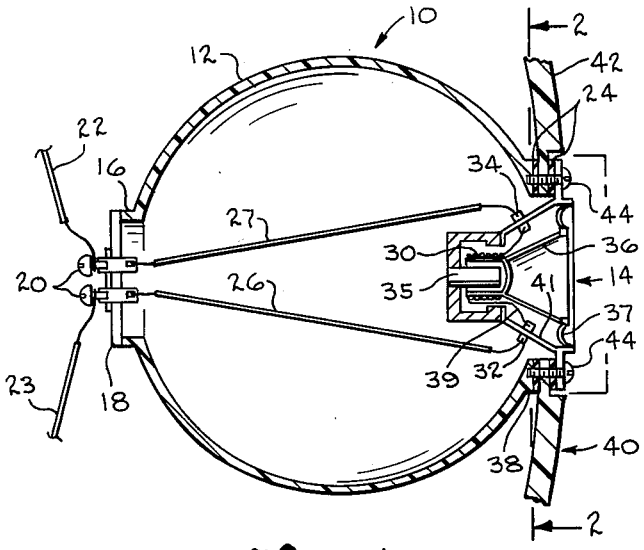
FIG. 1 is a cross section through a single loudspeaker module of the present invention mounted on a convex secondary enclosure.
Figure 2:
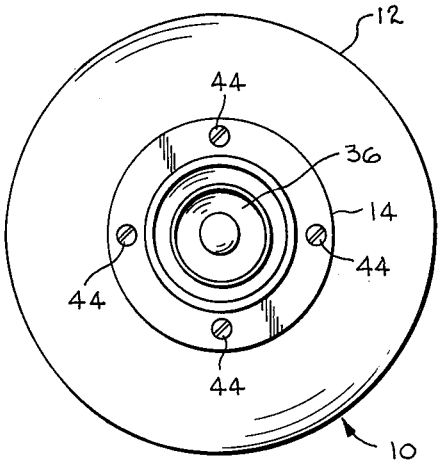
FIG. 2 is a plan view of only the module of FIG. 1, with the large secondary enclosure removed, as indicated by the section lines and arrows labeled "2—2" therein.

FIGS. 1 and 2 illustrate a typical assembly of loudspeaker, primary enclosure and secondary enclosure, in this instance a standard prior art cone type speaker and a convex secondary enclosure. In this embodiment a single module 10 is supported by the wall 42 of a common secondary enclosure 40. Each module 10 comprises a loudspeaker 14 and a spherical shell 12 preferably of hard material such as glass or rigid plastic in a thickness, for instance, of 1/16 to 3/16 inch, and a diameter of 6 to 16 inches for a 4 inch speaker. The secondary enclosure defined by the larger spherical shell 40 may be made of the same hard material, and may have a diameter, for instance, of 2 to 5 feet in an average size room. In addition to the forward opening receiving loudspeaker 14, the small spherical shell 12 has a rearward opening defined by the upstanding boss 16. This boss is provided with a cap 18 which closes the opening and is provided with a cap 18 which closes the opening and is provided with a pair of metal terminals 20. The outwardly projecting portion of each terminal 20 is connected to one of the leads 22 and 23 from an audio transformer while on the inside of this sphere the terminals 20 are connected to a pair of leads 26 and 27 having their opposite ends connected to the voice coil 30 of the speaker through speaker connections 32 and 34.

To mount the module 10 on the secondary enclosure 40, the speaker opening in shell 12 is provided with a thickened square boss 38 in the corners of which four blind holes are drilled and tapped. A similar set of registering holes are drilled in the wall 42 of the secondary enclosure, and the two enclosures and loudspeaker and are secured together by a multiplicity of threaded connecting members such as machine screws 44. A pair of gaskets 24 are also provided to dampen sound transmission through the enclosures and to seal the speaker against the flow of air from the inside of the primary enclosure 12 to the space in front of the assembly.

It may be noted here that, with an assembly having minimal air leakage, it may be necessary to provide a very small opening, less than 1/16 inch in diameter, in the wall of primary enclosure 12. The purpose of such an opening (not shown) would be to allow just enough air flow to assure that the air pressure within the primary enclosure adjusts itself to equal the ambient barometric pressure and any changes therein. This would generally be unnecessary with presently available loudspeakers, but one made very leaktight would require such a pressure equalizing opening. The secondary enclosures are generally open at the rear, but, if either made complete or sealed to a wall, a similar small opening may be provided in wall 42.

The loudspeaker 14 may be a conventional dynamic type of speaker employing the permanent magnet 35, the voice coil 30 operating in the air gap between parts of the magnet 35, paper cone diaphragm 36 having its truncated apex secured to one end of the voice coil 35, and the usual flexible supports 37 and 39 at outer and inner ends of the diaphragm, respectively, securing the diaphragm loosely to the metal framework 41 of the speaker.

More than one module 10 may, of course, be used with a single convex baffle plate or secondary enclosure 40, as set forth in the original patent, with all of the benefits therein set forth. Even a single module 10, however will benefit from the addition of the convex baffle plate 40, as the net result is a large increase in omnidirectionality. It will be apparent that the wall 42 of secondary enclosure 40 may be made in short sections, with each section, for instance, having a single module 10 assembled to it in the manner illustrated. Such units may be separately stored and shipped, and assembled together on the job.

Figure 3:
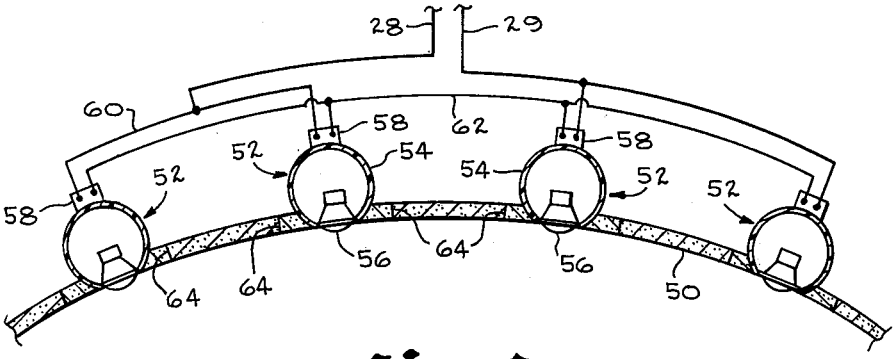
FIG. 3 is a section through a concave ceiling or wall having a multiplicity of spherical loudspeaker modules mounted therein and electrically interconnected by the wiring indicated schematically therein.

FIG. 3 is a somewhat schematic cross-section through a concave baffle plate or ceiling 50 having a multiplicity of modules 52 mounted thereon. Each module 52 consists of a primary enclosure 54 and a loudspeaker 56 mounted in a manner similar to that described for the previous figures, or for those below, so that the outer periphery of the speaker diaphragm is approximately flush with the sound-reproducing surface of the baffle 50. The primary enclosure 54 is any of those which defines a concavity having a smooth, essentially continuous surface, preferably a continuous curve such as a sphere, ellipsoid or other surface of revolution; it may have the form of a shell, as illustrated, or may be a block of material having such a cavity formed in it. The loudspeaker 56 may be any dynamic loudspeaker, such as that already described or, as illustrated, the dynamic loudspeaker 56 having a domed diaphragm, as disclosed in the prior patent of the present inventor, U.S. Pat. No. 3,925,626.

While only four modules 52 are shown in FIG. 3, it is apparent that the number used can be varied to fit the area and other circumstances. In a skating rink, for instance, where a high loudness level is the order of the day, there might be one module for every 100 square feet of floor space; with such a spread and with the amplifier gain control turned up to maximum, as is often done, the loudness level would definitely override all normal conversation. In more genteel circumstances, on the other hand, less than half as many modules would be required.

While the ceiling or baffle plate 50 may be a unitary ceiling to which modules 52 are assembled, it may also be divided into panels 64, each of which, for instance may be secured to a single module. Such assemblies may then be individually stored and shipped, and assembled together at the time of installation.

FIG. 3 also illustrates typical circuitry to simultaneously furnish a multiplicity of speakers with a common input signal, which may include all frequencies in the audio spectrum. As therein indicated, the four speakers 56 of the array may be linked together electrically by the series-parallel arrangement shown, wherein the two left hand speakers are connected in parallel with each other, and likewise for the two right hand speakers. The two pairs are then linked together in series, so that the net impedance presented to the audio amplifier through leads 28 and 29 is equal to the impedance of a single speaker, which is made possible by using identical speakers having the same impedance. All of the wiring may be done through the openings in the rear of the primary enclosures 54, utilizing terminals 58 and straps 60 and 62.

Figure 4:
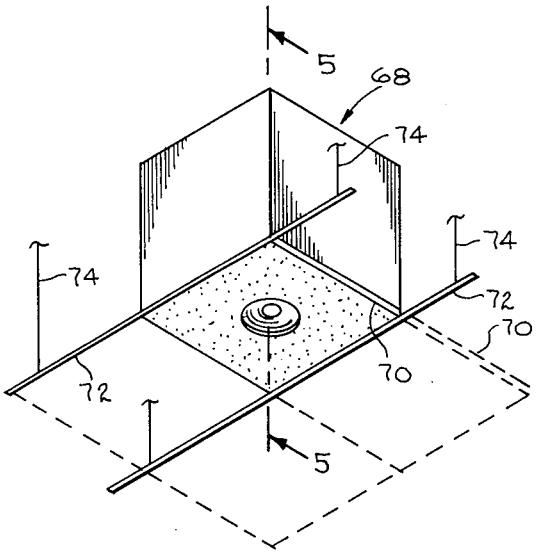
FIG. 4 is an isometric view of a flat ceiling or wall showing one of the modules of the remaining figures disposed thereon.

FIG. 4 illustrates the present invention in the context of an acoustic ceiling, i.e., a ceiling suspended at a spaced distance below a solid ceiling (not shown) and consisting primarily of replaceable, sound-absorbing panels or tiles such as panels 70. The framework for such a ceiling is typically two sets of mutually orthogonal sheet metal strips shaped as inverted T's 72, so that the upright leg serves as a separator while the horizontal leg supports adjacent tiles or panels (see FIG. 5). The two sets of strips are disposed in a common horizontal plane on a gridiron plan so that they define square openings, typically of a size to support 2 by 2-foot panels 70 about 1-inch thick and weighing about 2 pounds. Only two such strips 72 are shown in FIG. 4, the others being omitted to show other details. Also shown are the suspension wires 74 used to secure strips 72 to a solid ceiling, typically of concrete, and to support the ceiling at a definite spacing therebelow.

Figure 5:
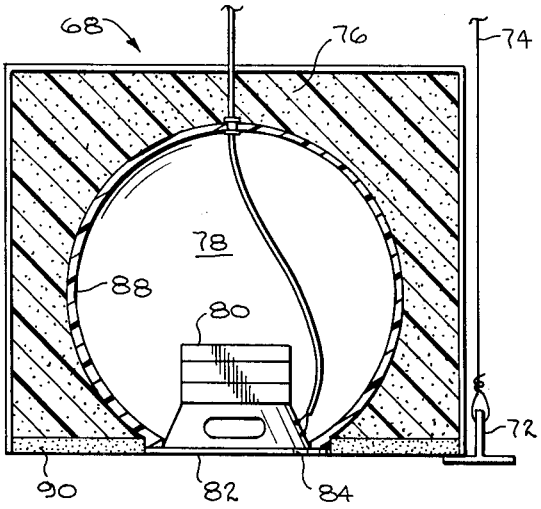
Figure 6:
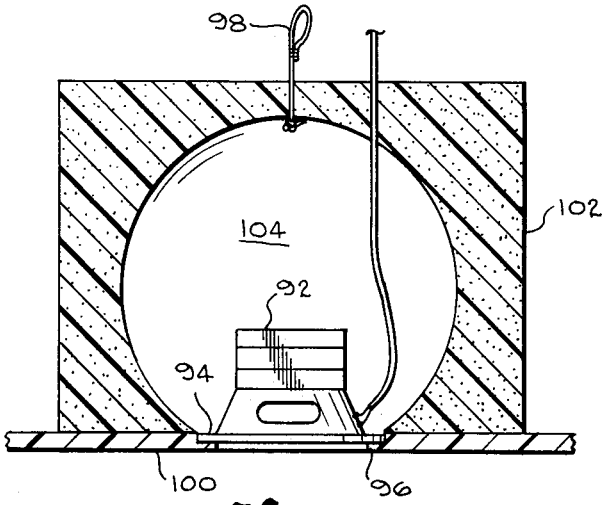
Figure 7:
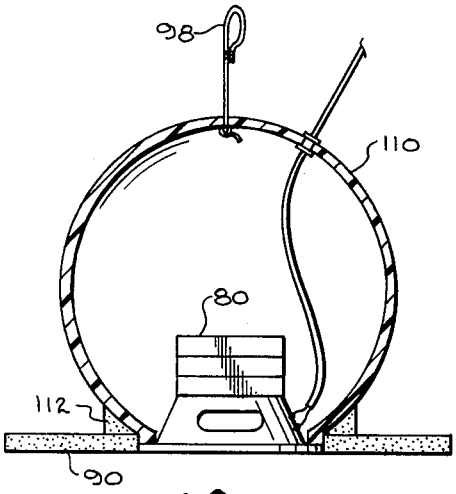
Figure 8:
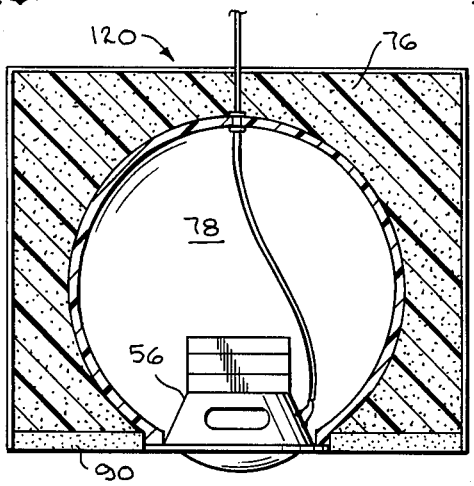

The module 68 shown in FIG. 4 is shown in greater detail in FIG. 5, although either of those shown in FIGS. 6, 7 and 8 could also be used. Module 68 is basically a cube 76 having a concavity 78 therein which is truncated to extend through one surface of the cube 76, intersecting it in an opening 82 which is preferably shaped to conform to the lower peripheral shape of loudspeaker 80. The loudspeaker is secured in the opening 82 so that it extends toward the center of opening 78 without support except at that portion 84 of its framework which surrounds and supports the outer peripheral edge of the diaphragm, which thus mounts the diaphragm essentially flush with the lower surface of baffle plate 90. In the arrangement shown in FIG. 5 it is necessary to secure the loudspeaker 80 to the cube 76 or its liner 88, as by threaded connectors not shown or adhesives, whereas for the FIG. 6 construction the only purpose of a similar connection is to prevent vibration.

Since the lightweight material selected for cube 76 may be somewhat frangible, the cube has been provided with an outer cover 86 and a liner 88 on the wall defining cavity 78. The cover 86 may be thought of as a decorative protection, but liner 88 will also define the sound absorbing cavity and needs more consideration. Ideally, it should furnish a smooth, relatively hard surface, and for this reason materials such as glass or hard plastics are preferred.

FIG. 6 illustrates an embodiment differing from that shown in FIG. 5 in only minor respects. Loudspeaker 92 has a built-in peripheral flange 94 which may be used for supporting it on a mating flange 96 of the baffle plate 100, and this figure also shows the use of a wire 98 to support the assembly from the solid ceiling above.

This embodiment also illustrates that the cavity-defining member 102 may be made of a material presenting no need for surface support, so that the cavity 104 requires no liner and the outer surface of member 102 requires no covering. In addition, the baffle plate 100 need not be coextensive with the lower surface of member 102, but may extend over a multiplicity of such members. It may also be made of a more rigid and less sound-absorbent material than the usual ceiling tile, making extra wires like 98 unnecessary.

In FIG. 7 there is illustrated the use of a module like that in FIG. 1, combining a shell type cavity-defining enclosure 110 with a loudspeaker 80. While such a module will rest on baffle plate 90 without any real need for additional structure, a suspension wire 98 may be used if desired. Also, for factory assembly of modules with secondary enclosures or baffle plates 90, an optional connecting collar 112 may be added, securing the same to shell 110 and baffle 90 by adhesives, for example.

FIG. 8 illustrates a module 120 which is identical with the module 68 of FIG. 5 except that the loudspeaker 56 is of the domed diaphragm type disclosed in the present inventor's prior U.S. Pat. No. 3,925,626. Such loudspeakers 56 are much superior to prior art cone diaphragm loudspeakers in omnidirectionality, particularly when used with flat or concave baffle plates, and may be substituted for any of the loudspeakers 80 and 92 shown in the preceding figures.

Figure 9:
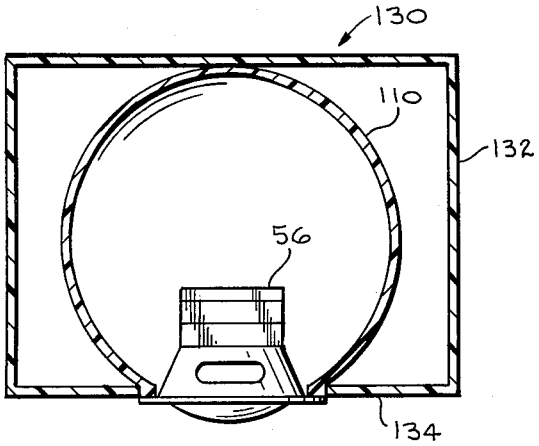
FIGS. 5–10 are sectional views showing various modules in combination with flat baffle plates, which may be ceiling tiles or cabinet panels.

FIG. 9 illustrates an alternate embodiment in which the module 130 includes a hollow box member 132 and a cavity-defining member such as the spherical shell 110, as well as the loudspeaker 56. Parts 132 and 110 may be made of good sound reflective material such as a hard plastic, and yet not make the assembly unduly heavy, and the lower surface 134 of the hollow box will furnish the desired baffle surface.

Figure 10:
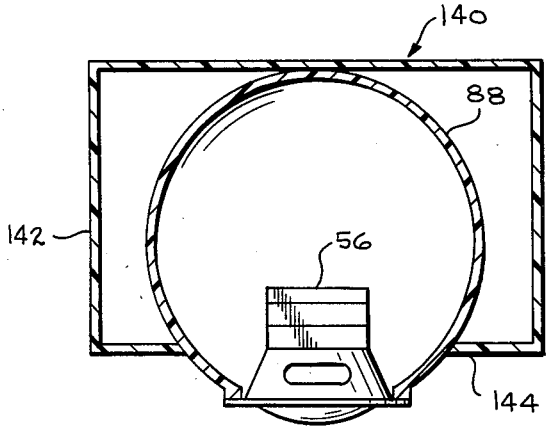

FIG. 10 is a further modification 140 showing that the subassembly of loudspeaker 56 and spherical shell 88 may protrude slightly from the baffle surface 144 of the hollow box enclosure 142, if desired to take advantage of the resulting eye pleasing effect. While the flush arrangement of FIG. 9 is preferred, the angle at which baffle surface 144 meets the curved shape of shell 88 is not so sharp as to seriously affect the resulting sound quality.

While several embodiments of the invention have been illustrated and described, it is to be understood that the invention is not limited thereby, but embraces all variations, which will now occur to those skilled in the art, whereby substantially the same results are obtained by substantially the same manner. The invention should not be limited to the specific variants illustrated, but only to the claims set forth below.

What is claimed is:

1. A high fidelity loudspeaker system comprising a multiplicity of modules each consisting essentially of a loudspeaker having a diaphragm and a magnet structure together with a member having a generally spherical cavity, said cavity being truncated with a circular opening and the loudspeaker being secured to and supported by the member so that its diaphragm lies in and fills said circular opening while the magnet structure extends cantilever style into the generally spherical cavity, in combination with a number of baffle plates having openings therein to receive and support said modules with said diaphragms disposed in said openings and essentially flush with the outer surface of said baffle plate, there being a like multiplicity of openings in said baffle plates and each such opening supporting one of said modules, said baffle plates being disposed so that their nether surfaces form an essentially continuous surface, said loudspeakers being electrically interconnected to reinforce one another, whereby each speaker may be utilized to receive a common input signal covering the full audio spectrum.

2. In a high fidelity sound reproduction system, at least two modules each consisting of a relatively small loudspeaker and a speaker enclosure having a concavity therein with an essentially spherical shape, said concavity being truncated to define an enclosure opening, the speaker being mounted in said concavity with the periphery of its diaphragm essentially filling and closing said opening, said speakers being approximately of the same size and said enclosure concavities also being approximately of the same size, together with a number of baffle plates on which said modules are mounted with said enclosure openings substantially coincident with similar opening in the baffle plates, said loudspeakers being electrically interconnected for simultaneous reproduction of a common input signal, and said baffle plates together defining an essentially continuous surface surrounding said openings.

3. In a high fidelity sound reproduction system, a multiplicity of loudspeaker modules mounted on a number of baffles presenting to the listener an essentially continuous common surface, each said module comprising a single dynamic loudspeaker having a magnet at one end and a diaphragm at the other, and a single cavity-defining primary enclosure, said cavity being bounded by a smooth, substantially continuous curved surface, said cavity being truncated to define an opening in the enclosure, and said loudspeaker being supported on said enclosure with its magnet end extending into said cavity while its diaphragm end fills and closes said opening, said baffles containing spaced apart openings substantially identical with the enclosure openings, and receiving said modules with the two sets of openings in closing registry with one another and with the periphery of said loudspeaker diaphragm flush or closely adjacent said baffle surface, said loudspeakers being electrically interconnected for simultaneous reproduction of a common input signal.

4. The improved loudspeaker system of claim 3 in which said cavity is generally spherical and said loudspeaker is of the domed diaphragm type, having an outwardly convex diaphragm and an extended voice coil form connected to the center portion of said diaphragm, said loudspeaker having an unfilled space behind said convex diaphragm and surrounding said extended voice coil form, said space connected to said cavity so that sound waves emenating from the backface of the diaphragm will be reduced or eliminated in said cavity.

5. An article of manufacture for a high fidelity sound reproduction system, said article comprising a single dynamic loudspeaker and a block-shaped cavity-defining primary enclosure having one face intersected by said cavity to define a single opening, the remaining area of said face defining a rigid baffle surface, the cavity in said enclosure except for said opening being defined by a smooth, substantially continuous curved surface, said loudspeaker having a longitudinal axis with inner and outer ends, a magnet structure at the inner end and a diaphragm at the outer end, said loudspeaker being disposed in the enclosure with its magnet and disposed in said cavity and its diaphragm end supported by the enclosure to fill and close said opening.

6. The article of manufacture of claim 5 in which said primary enclosure is a block which is solid except for said cavity.

7. The article of manufacture of claim 5 in which said primary enclosure is a hollow block having a number of flat walls and includes an interior curved shell disposed within said walls and intersecting one of them, the inner surface of said shell defining the curved surface of said cavity.

8. The article of manufacture of claim 5 in which said baffle surface is arcuate in at least one direction.

9. An article of manufacture for a high fidelity sound reproduction system, comprising in combination a loudspeaker, a primary enclosure and a baffle plate, A. said loudspeaker having a longitudinal axis with inner and outer ends, a magnet disposed at the inner end and a diaphragm disposed at the outer end, B. said primary enclosure being a block of lightweight material and having an internal substantially unvented concavity intersecting one of the exterior faces of the block in an opening, said concavity being defined by a substantially continuous curved surface, C. said baffle plate being a panel of material matching the surface of a ceiling or wall of a room or piece of furniture, and having an opening therethrough substantially identical to the opening in said primary enclosure, said baffle plate being secured to the face of the primary enclosure surrounding the opening therein with said openings substantially coincident, and said loudspeaker being disposed with its magnet and extending cantilever style within said concavity and its diaphragm end supported by the enclosure to fill and close said openings.

10. The article of manufacture of claim 9 in which said baffle plate is a flat plate of sound reflective material.

11. The article of manufacture of claim 9 in which said baffle plate is a ceiling tile.

12. The article of manufacture of claim 9 which further includes a linear of sound reflective material lining the surface of said concavity.

13. In a high fidelity sound reproduction system, the combination of

A. a dynamic loudspeaker having a longitudinal axis with inner and outer ends, a magnet disposed at the inner end and a single membrane diaphragm at the outer end, B. a primary enclosure defining a substantially unvented concave cavity and having an opening to said cavity, said cavity being defined by a substantially continuous curved surface, and C. an outwardly convex secondary enclosure or baffle plate also having an opening therethrough of substantially the same size as the opening in said primary enclosure, said enclosures being secured together with said openings substantially coincident, said loudspeaker being disposed with its inner end extending cantilever style within said cavity and supported on said enclosures at its outer end with said diaphragm filling said openings and the outer periphery of the diaphragm approximately flush with the outer surface of the secondary enclosure.

* * * * *